United States Patent [19]

Dill et al.

[11] 3,997,374

[45] Dec. 14, 1976

[54] HEAT TREATMENT OF WELDS

[75] Inventors: Herbert C. Dill; Allen E. Wisler, both of Houston, Tex.

[73] Assignee: Hughes Tool Company, Houston, Tex.

[22] Filed: Nov. 18, 1974

[21] Appl. No.: 524,919

Related U.S. Application Data

[63] Continuation of Ser. No. 269,648, July 7, 1972, abandoned.

[52] U.S. Cl. ..... 148/127; 148/34; 228/238

[51] Int. Cl.[2] ..... C21D 1/66; C21D 9/50

[58] Field of Search ..... 148/127, 34; 29/497, 29/498

[56] References Cited

UNITED STATES PATENTS

| | | | |
|---|---|---|---|
| 1,704,410 | 3/1929 | Stedefield | 148/127 |
| 2,032,977 | 3/1936 | Delachaux | 148/127 |
| 2,133,926 | 10/1938 | Ransom et al. | 148/127 |
| 2,564,391 | 8/1951 | Burns | 148/127 |
| 2,834,871 | 5/1958 | Berg | 148/127 |
| 3,192,080 | 6/1965 | Cooper | 148/127 |
| 3,294,599 | 12/1966 | Huseby | 148/143 |
| 3,556,877 | 1/1971 | Ujiie | 148/143 |

*Primary Examiner*—Arthur J. Steiner
*Attorney, Agent, or Firm*—Robert A. Felsman

[57] ABSTRACT

A method is disclosed for heat treating the weld and heat affected zone between a metal pipe and a metal connector. The overall strength of the assembly in the heat affected zone of the weld is brought to a value higher than, or at least matching, that of the strength of the pipe body in a manner to avoid cracking and to insure that the weld or the heat affected zone does not fail. After welding in the conventional manner, the weld is cooled below the transformation temperature, heated above the critical temperature, quenched at a selected rate that avoids cracking and refines the grain structure, followed by tempering, all of which improve the mechanical properties.

9 Claims, 5 Drawing Figures

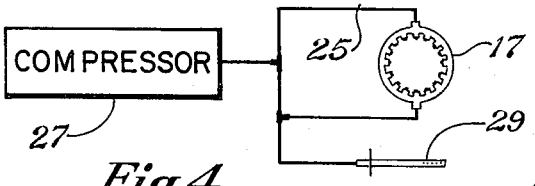
Fig.4
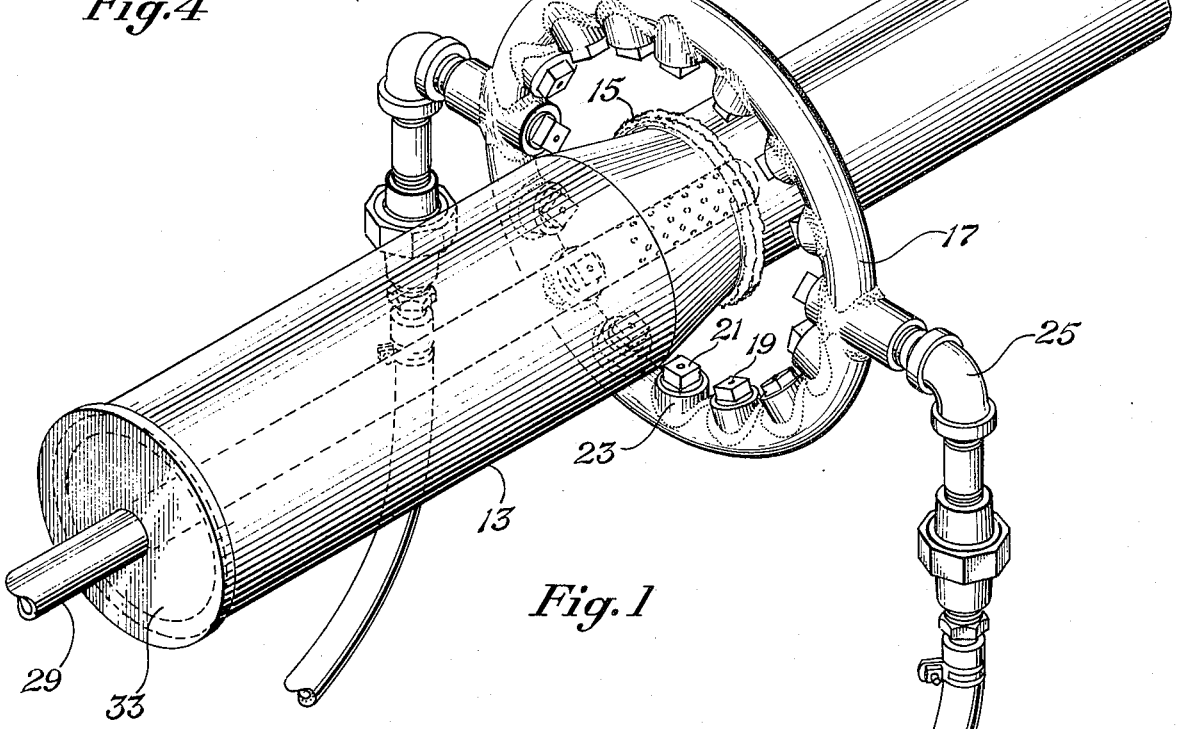
Fig.1
Fig.2
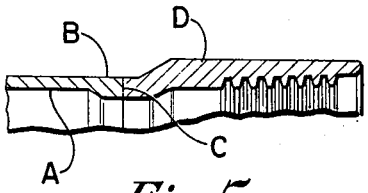
Fig.5
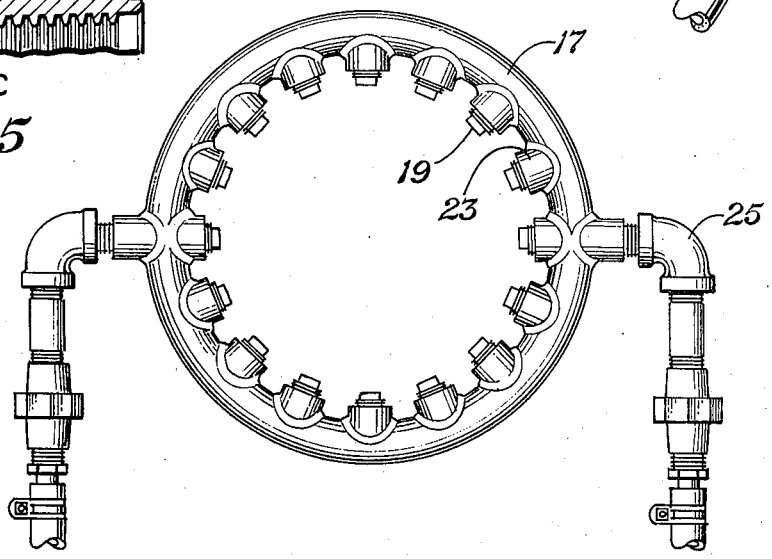
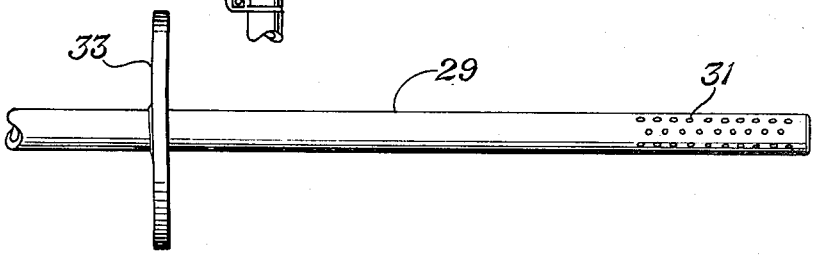
Fig.3

HEAT TREATMENT OF WELDS

Cross Reference To Related Application

This is a continuation of application Ser. No. 269,648, filed July 7, 1972, now abandoned.

BACKGROUND OF THE INVENTION

1. Field of the Invention

This invention relates in general to the post welding heat treatment of the welds of tubular members. It is especially suitable for increasing the strength in the weld and the heat affected zone to produce an overall strength that at least matches that of the body of the tubular member.

2. Description of the Prior Art

It is common to use electrical resistance (flash-butt) welding to join tubular members such as drill pipe and their rotary connectors, called "tool joints", in the oil well drilling industry. It is important that the weld and the heat affected zone be able to carry as high a tensile load and be able to withstand fatique stresses or impacts as well as the pipe used in the assembly. Otherwise, the weld or the heat affected zone may not have adequate load carrying capability and may fail when subjected to the severe stresses commonly encountered during oil well drilling.

With reference to FIG. 5, a drill pipe A usually has an area B of increased cross-section on each end called an upset, which is welded at C to a tool joint D. It is possible to have a lower yield strength of the metal in the heat affected zone of weld C than in the body A of the pipe and still have greater overall strength in the weld and heat affected zone. This is due to the larger cross-sectional area in upset B as compared with smaller cross-sectional area of the nonupset portion or body A of the pipe. Typical ratios of an upset B cross-sectional area to the pipe body A cross-sectional areas may range from 1.38 to 2.10 for commercially available assemblies. In some of the high strength pipe assemblies the load carrying capability of the heat affected zone around the weld C does not compare favorably with that of the pipe or tool joint when utilizing the prior art heat treatments such as normalizing and tempering the weld. In one prior art example, a 3½ inch diameter 15.50 pound, S-135 drill pipe had a yield strength of 89,900 psi in the heat affected zone of upset B that was heat treated by normalizing and tempering, whereas the body A of the pipe had a yield strength of 140,000 psi. The ratio of the cross-sectional areas of the upset portion B of the pipe to the body A of the pipe was 1.42 to 1. With the pipe having a yield strength of 140,000 psi, a minimum yield strength of 99,000 psi is required in the heat affected zone of the upset B to essentially match the load carrying capability of the pipe. Using a safety factor of 10%, then the minimum yield strength of the heat affected zone should be at least 110,000 psi. The prior art method of normalizing and tempering the heat affected zone has been found incapable of producing such a yield strength in the heat affected zone.

The problem is more difficult than simply increasing the hardness of the weld and heat affected zone. Hardening too fast leads to the formation of cracks. Further, excessive hardness and brittleness leads to failures.

SUMMARY OF THE INVENTION

The invention may be summarized as method and apparatus for heat treating welds such that their overall strengths match those of the pipe bodies to which they are connected. To accomplish this result, a post welding heat treatment is provided that includes quenching the weld and heat affected zone at a cooling rate that is limited to produce an appropriate level of hardness without cracking. Too rapid cooling may result in cracking and too slow cooling will not provide the proper hardness level. For the relatively thick sections of pipe to which tool joints are welded for oil well drilling, air quenching is preferably performed on the exterior, as well as in the interior, circumferential surfaces of the weld. As a consequence, the entire cross-sectional thickness of the weld and heat affected zone is hardened satisfactorily, without cracking. For best results, the post welding treatment includes cooling the weld to a selected temperature, reheating and quenching, and then tempering.

Apparatus for performing the method comprises a ring shaped manifold with nozzle means spaced along the periphery to direct the flow of gaseous fluid inwardly. A mandrel means for insertion inside the tool joint and pipe has nozzle means to direct the flow of gaseous fluid outwardly.

Other objects, features and advantages of the invention will become apparent in the following detailed description.

BRIEF DESCRIPTION OF THE DRAWING

FIG. 1 is a perspective view as seen obliquely from one end of a pipe and tool joint, with a ring shaped manifold and mandrel positioned to direct the flow of gaseous fluid against the heat affected zone of a weld in accordance with the principles of the invention;

FIG. 2 is an end view of a ring shaped manifold, nozzle means and connections of the form also shown in FIG. 1;

FIG. 3 is a side elevation view of the mandrel shown in FIG. 1;

FIG. 4 is a schematic diagram of a pneumatic circuit for supplying gaseous fluid to the manifold and mandrel; and FIG. 5 is a fragmentary side elevation view in longitudinal section of one-half of a tool joint and the end of an upset drill pipe to which it has been welded.

DESCRIPTION OF THE PREFERRED EMBODIMENT

Referring initially to FIG. 1 of the drawing, a pipe 11 has secured to one end a connection member or tool joint 13 by means of a weld 15, generally formed by the electrical resistance (flash-butt weld) technique. This welding technique is well known, having been utilized for decades for such purposes as connecting tool joints to drill pipe used in rotary well drilling.

A ring shaped manifold 17 is shown positioned concentrically about the weld 15. A plurality of nozzle means 19 are secured to the inner periphery of the manifold, which has in this instance the geometric form known as the torus. Such nozzle means here is an element with a polygon shaped head through which extends an orifice 21. The lower end of each element is preferably threaded for releasable attachment to a nozzle element pedestal 23 secured to the manifold. As shown, the nozzle elements are closely spaced along the inner periphery of the manifold such that the discharge of gaseous fluid from the orifices 21 tends to impinge against the entire circumferential area of the heat affected zone generated during welding.

Suitable connections 25 are utilized so that a gaseous fluid may be transmitted by a compressor 27 to the manifold, and also to a mandrel or probe 29 adapted for insertion within the tool joint 13 and end of pipe 11. The probe is preferably concentrically aligned with the tool joint such that its nozzle means or orifices 31 are equidistant from the tool joint. Here, as with the manifold, the number and spacing of the nozzle means is selected such that the gaseous fluid tends to flow against the entire circumferential area of the interior surface of the weld 15. The term "nozzle means" is used in its broadest sense to cover orifices, nozzles or any other form of openings through which a fluid may be directed.

For the purpose of controlling the axial position of the orifices 31 of mandrel 29 relative to the weld 15, a positioner means 33 is used. Here the positioner is in the form of a shoulder secured to a mid-region of the mandrel 29 to extend radially outward into engagement with the extremity of the tool joint 13.

The method of the invention may be practiced by utilizing the pump 27, manifold 17, and mandrel 29 for pumping a fluid transversely against the exterior and interior circumferential surfaces of the weld 15.

The following is a specific example of one way in which the method was successfully practiced:

A joint of the previously described 3½ inch, 15.50 pound, S-135 steel pipe, having a yield strength of approximately 140,000 psi, was welded to a tool joint of AISI 4137H steel by the flash-butt welding method. The ends of the pipe had an upset region B having a cross-sectional thickness greater than the cross-sectional thickness of the body A of the pipe by a ratio of 1.42 to 1.

Next, the heat affected zone was cooled to below 125° F.

Then, the assembly was heated in an induction coil to a temperature from about 1750° to 1800° F.

Thereafter, the manifold 17 and mandrel 29 were positioned approximately as shown in FIG. 1 to pump a gaseous fluid, that in this instance was air at a temperature of about 100° F., transversely against the interior and exterior circumferential surfaces of the weld. The pressure above the mandrel and manifold was 53 psig and the time of cooling was 1¼ minutes. The manifold had a total of sixteen, drilled orifices for nozzle means, eight of which were seven-sixtyfourth inch diameter and evenly spaced to direct fluid perpendicular with the pipe longitudinal axis. The other eight orifices were 1/8 inch diameter holes inclined at 7½° relative to the longitudinal axis of the pipe. The mandrel was constructed of thin wall tubing of 1.050 inch outside diameter and 0.824 inch inside diameter. There were 56 drilled orifices, half of which were 7/64 inch diameter and half one-eighth inch diameter, all evenly spaced circumferentially and over a length of 4¼ inches in order to direct fluid uniformly and perpendicularly against the weld and inner pipe surface.

Finally, the assembly was tempered to a temperature of 1175° F.

As a result of using the above method and apparatus, the yield strength of the weld and heat affected zone increased from 89,900 to 120,500. Since the minimum yield strength acceptable in the upset area B is 110,000 psi after utilization of a safety factor of 10%, the treatment successfully increased the strength of the heat affected zone to a satisfactory value.

In the above described preferred embodiment, the weld must be initially cooled below the transformation temperature but need not be cooled to a temperature as low as 125° F. for satisfactory results under all conditions. Such cooling may be accomplished by discharging water at normal hydrant temperatures in a stream that impinges on the pipe circumferentially about eight inches from the weld. After thus cooling, the weld and heat affected zone may be heated by suitable means such as an induction coil to a satisfactory pre-quenching temperature preferably above the upper critical such as that specified. This temperature must be above the lower critical to obtain any beneficial results. The quenching by air as described lowers the temperature to below about 600° F. at a cooling rate that avoids the formation of extremely brittle structures that are likely to crack. Air is not the only fluid that will accomplish this result. Some liquids such as oils or other suitable quenchants are capable of accomplishing a satisfactory result, although not with exactly the same cooling rate. After suitable tempering the metal in any instance must have a minimum yield strength that produces an overall strength in the weld area comparing favorably with that of the pipe.

It should be apparent from the foregoing that an invention has been provided having significant advantages. Through utilization of the method, the strength of the weld and heat affected zone may be increased to a level at least matching that of the body of the pipe. Further, the hardness of the heat affected zone is obtained in a manner that avoids cracks and is easily controlled. It has been found that the time duration of the air quenching is not critical so long as a satisfactory minimum such as 1¼ minutes is used for the example given. This is especially advantageous in high production manufacturing since some variations in timing may be expected.

While the invention has been shown in only one of its forms, it should be apparent to those skilled in the art that it is not so limited, but is susceptible to various changes and modifications without departing from the spirit thereof. The term fluid therefore encompasses liquids that meet the above requirements. The term gaseous fluid includes gasses that may include a mist such as steam. Modifications to the method steps and to the specific manner of carrying out the method will become apparent to those skilled in the art in view of the previous description, as will modifications to the form of apparatus.

We claim:

1. The method of welding and heat treating a pipe and a connector, the method comprising the steps of:

welding a steel connector to one end of a steel pipe;

cooling the weld below the transformation temperature of said steel pipe and connector;

heating the weld and heat affected zone to a temperature range of about 175° to 1800° F;

quenching the weld and heat affected zone by forcing a gaseous fluid across the zone simultaneously on the interior and exterior of said pipe and connection to harden them across their cross-section without cracking and to increase their overall strength to a value matching that of the pipe; and tempering the weld and heat affected zone.

2. The method of welding and heat treating an upset end of a high strength steel pipe and a mating tool joint, the method comprising the steps of:

welding a steel joint to the upset end of the pipe;

cooling the weld below the transformation temperature heating the weld effected zone by an induction coil to a temperature range of about 1750° to 1800° F;

quenching the weld and heat affected zone by forcing a gaseous fluid across the interior and exterior of said pipe and tool joint zone at a cooling rate slower than submersion in water but substantially faster than obtained by normalizing to harden them across their cross-sections;

tempering the weld and heat affected zone;

the quenching and tempering resulting in a hardness to produce a yield strength in the weld and heat affected zone such that their overall strenth at least matches that of the nonupset body of the pipe.

3. The method of welding and heat treating a steel pipe and a steel connector, the method comprising the steps of:

welding the connector to one end of the pipe;

cooling the weld and heat affected zone below the transformation temperature;

heating the weld and its resulting heat affected zone by an induction coil to a temperature range of about 1750° to 1800° F;

quenching by spraying with a gaseous fluid the interior and exterior surfaces of the weld and heat affected zone to effect a cooling rate that is slower than submersion in water but substantially faster than obtained by normalizing to harden them across their cross-section at a rate to aviod cracking;

tempering the weld and heat affected zone;

whereby an overall strength is produced matching that of the pipe.

4. The method of welding and heat treating an upset end of a steel pipe and a steel tool joint, the method comprising the steps of:

welding the tool joint to the upset end of the pipe;

cooling the weld and heat affected zone to a temperature below the transformation temperature;

heating by an induction coil the weld and heat affected zone to a temperature above critical to about 1750° to 1800° F;

quenching the weld and heat affected zone from a temperature above critical by spraying with a gaseous fluid to lower their temperatures to at least as low as about 600° F. in about 1¼ minutes; and tempering the weld and heat affected zone.

5. The method defined by claim 4 wherein said tempering is to approximately 1175° F.

6. The method defined by claim 5 wherein the gaseous quenching fluid is air.

7. The method of welding and heat treating an upset end of a steel pipe and a steel connector, the method comprising the steps of:

welding a tool joint to the upset end of the pipe;

cooling the weld and heat affected zone to a temperature below the transformation temperature;

heating the weld and heat affected zone to a temperature range of about 1750° to 1800° F;

quenching the weld and heat affected zone by pumping air against the exterior circumferential surface of the weld and simultaneously pumping air against the interior circumferential surface of the weld to harden them across their cross-section without cracking;

tempering the weld and heat affected zone.

8. The method defined by claim 7 wherein said tempering is to approximately 1175° F.

9. The method defined by claim 8 wherein the air is at a temperature of approximately 100° F.

* * * * *